US012805684B2

(12) United States Patent
Davila et al.

(10) Patent No.: US 12,805,684 B2
(45) Date of Patent: Nov. 24, 2026

(54) SURFACE CLEANER

(71) Applicant: Techtronic Floor Care Technology Limited, Tortola (VG)

(72) Inventors: Rafael Davila, Kannapolis, NC (US); Malia Reid, Statesville, NC (US); Matthew Johnson, Cornelius, NC (US); Gregory Clark, Charlotte, NC (US)

(73) Assignee: TECHTRONIC FLOOR CARE TECHNOLOGY LIMITED, Tortola (VG)

( * ) Notice: Subject to any disclaimer, the term of this patent is extended or adjusted under 35 U.S.C. 154(b) by 400 days.

(21) Appl. No.: 18/550,079

(22) PCT Filed: Mar. 11, 2022

(86) PCT No.: PCT/US2022/020057

§ 371 (c)(1),
(2) Date: Sep. 11, 2023

(87) PCT Pub. No.: WO2022/192746

PCT Pub. Date: Sep. 15, 2022

(65) Prior Publication Data

US 2024/0148209 A1 May 9, 2024

Related U.S. Application Data

(60) Provisional application No. 63/159,728, filed on Mar. 11, 2021.

(51) Int. Cl.

| | |
|---|---|
| ***A47L 11/30*** | (2006.01) |
| ***A47L 9/24*** | (2006.01) |
| ***A47L 11/40*** | (2006.01) |

(52) U.S. Cl.

CPC ..... *A47L 11/302* (2013.01); *A47L 9/242* (2013.01); *A47L 11/4016* (2013.01);
(Continued)

(58) Field of Classification Search

CPC .. A47L 9/242; A47L 11/4088; A47L 11/4083; A47L 11/4041; A47L 11/4016; A47L 11/302
(Continued)

(56) References Cited

U.S. PATENT DOCUMENTS

| | | | | |
|---|---|---|---|---|
| 6,134,744 | A | 10/2000 | Kasen et al. | |
| 2015/0216385 | A1* | 8/2015 | Bantum | A47L 11/4088 15/322 |

(Continued)

FOREIGN PATENT DOCUMENTS

| | | | | |
|---|---|---|---|---|
| DE | 69214245 | T2 | 4/1997 | |
| EP | 3482668 | A1 | 5/2019 | |
| GB | 2420967 | A * | 6/2006 | A47L 11/40 |

OTHER PUBLICATIONS

International Search Report and Written Opinion for Application No. PCT/US2022/020057 dated Jun. 20, 2022 (13 pages).

*Primary Examiner* — Katina N. Henson
(74) *Attorney, Agent, or Firm* — MICHAEL BEST & FRIEDRICH LLP

(57) ABSTRACT

A surface cleaner operable in a reclined use position and an upright position with an accessory. The accessory is positioned to be coupled to a lower portion of a recovery tank.

20 Claims, 12 Drawing Sheets

(52) U.S. Cl.
CPC ..... *A47L 11/4041* (2013.01); *A47L 11/4083* (2013.01); *A47L 11/4088* (2013.01)

(58) Field of Classification Search
USPC ..... 15/300.1
See application file for complete search history.

(56) References Cited

U.S. PATENT DOCUMENTS

| | | | | |
|---|---|---|---|---|
| 2016/0220080 | A1* | 8/2016 | Thorne | A47L 9/0455 |
| 2019/0133398 | A1* | 5/2019 | Chavana, Jr. | A47L 11/4041 |
| 2019/0183311 | A1 | 6/2019 | Diana et al. | |

* cited by examiner

SURFACE CLEANER

CROSS-REFERENCE TO RELATED APPLICATIONS

This application claims priority to U.S. Provisional Patent Application No. 63/159,728, filed Mar. 11, 2021, the entire contents of which are hereby incorporated by reference herein.

BACKGROUND

The present invention relates to surface cleaners, and more particularly, surface cleaners with an accessory.

SUMMARY

In one embodiment a surface cleaner is disclosed including a housing with a body and a base. The base is pivotally coupled to the body and configured to support the body above a cleaning surface. The surface cleaner further includes a recovery tank coupled to the housing, a nozzle, and an accessory. The recovery tank has an upper portion, a lower portion, and a recovery tank inlet disposed in the lower portion. The base includes a suction inlet port in fluid communication with the recovery tank inlet. The suction inlet port defines an inlet axis. The nozzle is removably coupled to the suction inlet port connecting a nozzle inlet to the recovery tank. The suction inlet port is accessible when the nozzle is uncoupled. The accessory includes a hose connector connectable to the suction inlet port when the nozzle is uncoupled. The accessory extends along the inlet axis when coupled.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

The present disclosure relates to a surface cleaner, specifically a surface cleaner with at least two different methods of cleaning. In one embodiment, the surface cleaner is a wet surface cleaner. The wet surface cleaner can be propelled over a surface by a user or can clean using an accessory attached to a suction inlet port to clean in a spot or above floor mode. The surface cleaner includes a recovery tank and a supply tank. The accessory connects to the suction inlet port of the surface cleaner. The accessory is connected in fluid communication with the recovery tank and the supply tank. This arrangement promotes efficient connection of the accessory, a compact and direct air path from the accessory, and an intuitive user experience, among other benefits.

Figure 1:
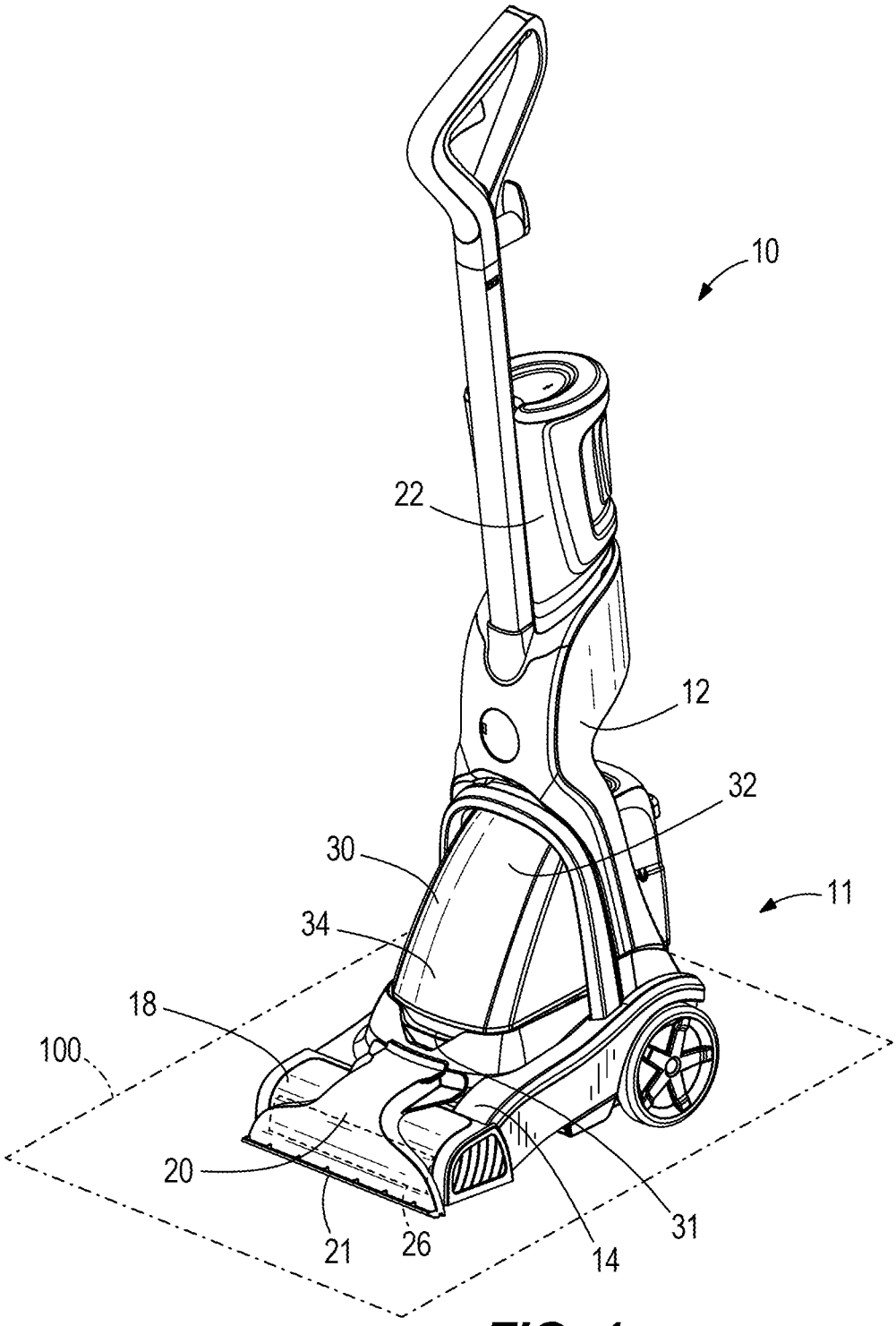
FIG. 1 is a perspective view of a surface cleaner according to one embodiment.
Figure 2:
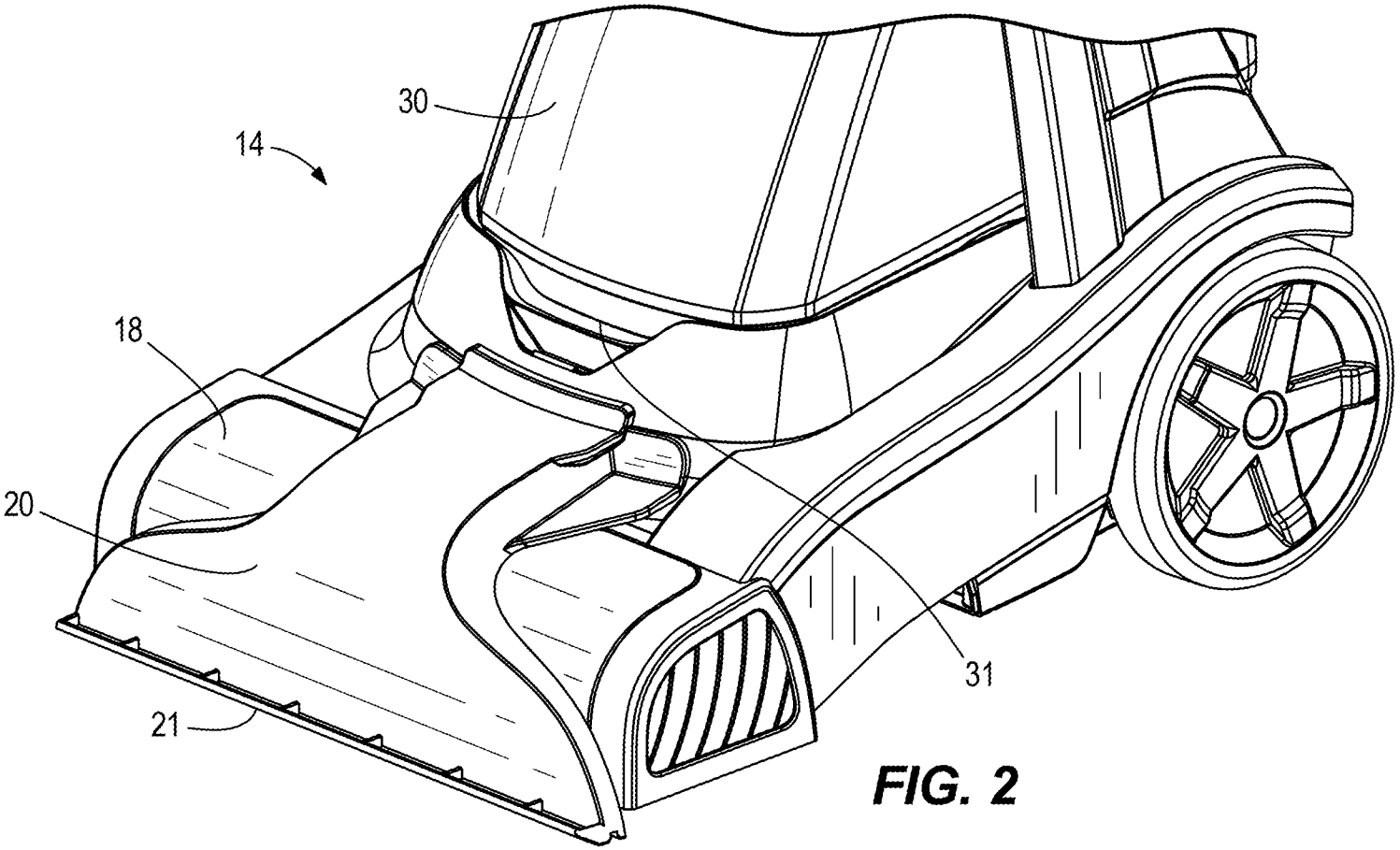
FIG. 2 is a perspective view of a base of the surface cleaner of FIG. 1.
Figure 3:
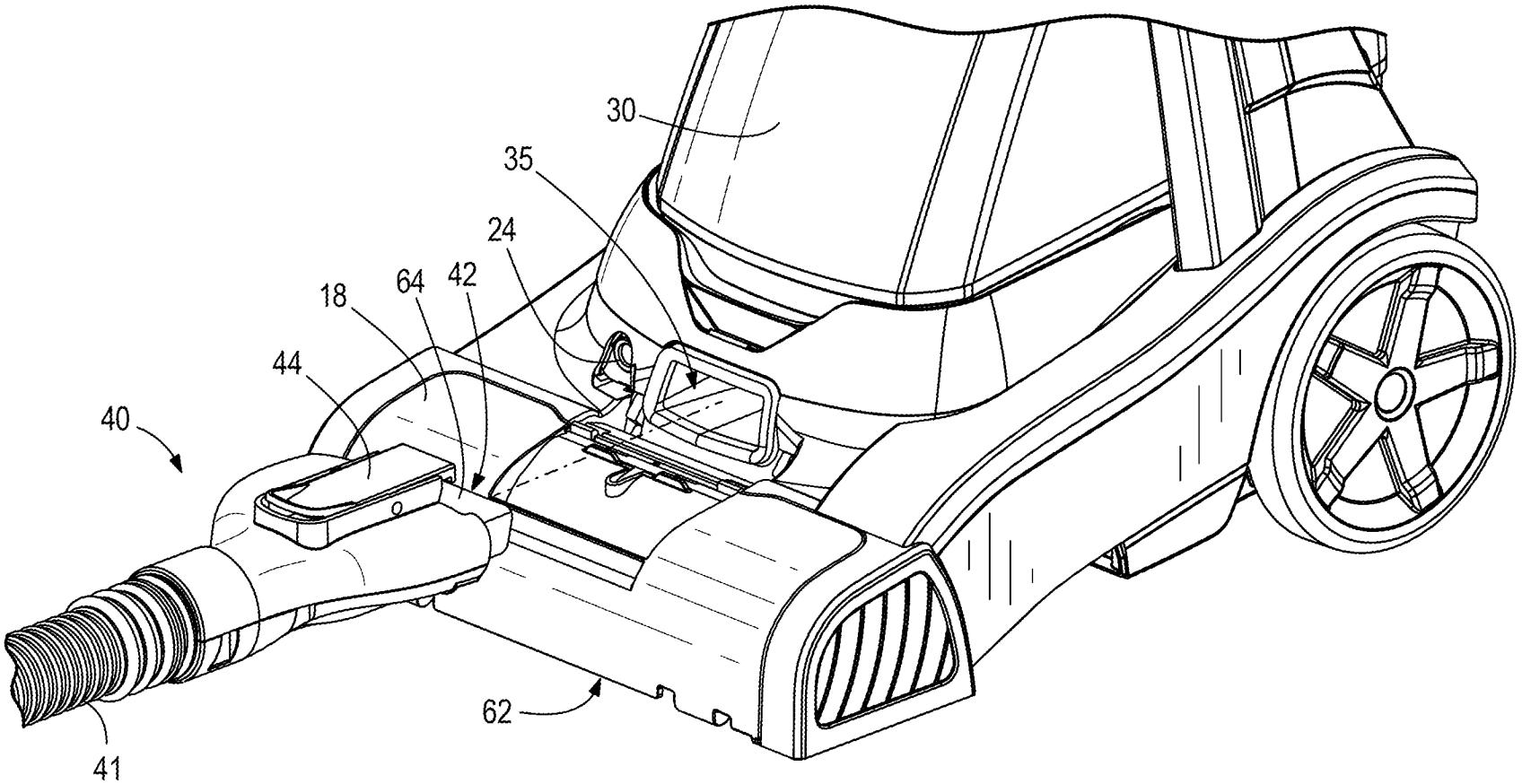
FIG. 3 is the perspective view of FIG. 2 with a nozzle removed from the base and an accessory in a removed position.

FIG. 1 illustrates a perspective view of a surface cleaner 10 according to an embodiment of the invention. The illustrated surface cleaner 10 is a surface cleaner, such as an extractor, a hard floor cleaner, or the like, that includes a suction source 19 (FIG. 6) to vacuum a fluid. The surface cleaner 10 has a housing 11 including a main body 12 with a base 14 that supports the surface cleaner 10 on a surface to be cleaned 100. The base 14 is pivotably coupled to the body 12, the body 12 pivotable between an upright storage position and a reclined use position. The surface cleaner 10 includes a supply tank 22 configured to provide a cleaning liquid to the surface to be cleaned 100 and a recovery tank 30 configured to contain debris and/or liquid collected from the surface to be cleaned.

Figure 4:
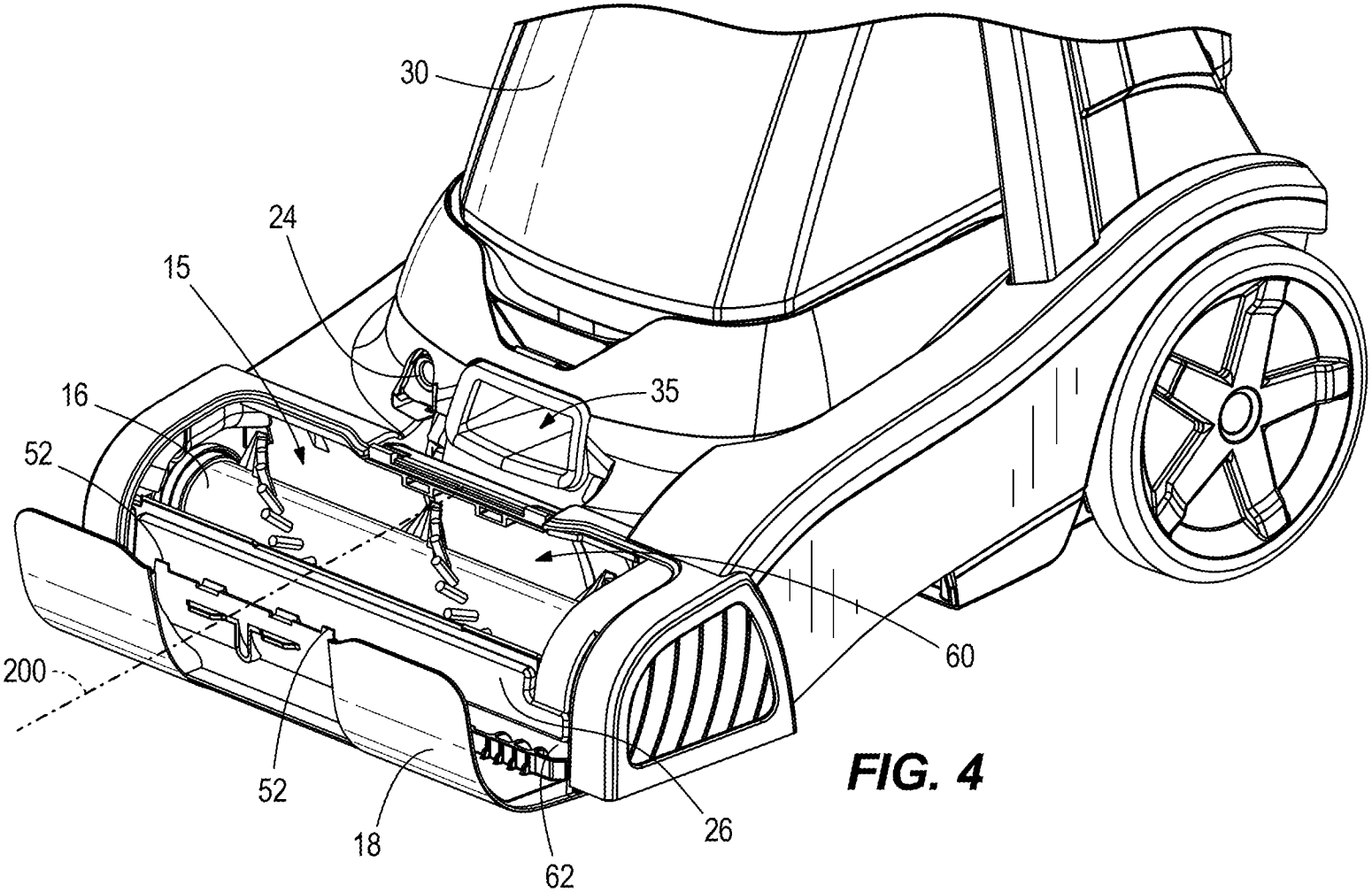
FIG. 4 is the perspective view of FIG. 2 shown with the nozzle removed and an agitator cover in a pivoted open position.
Figure 5:
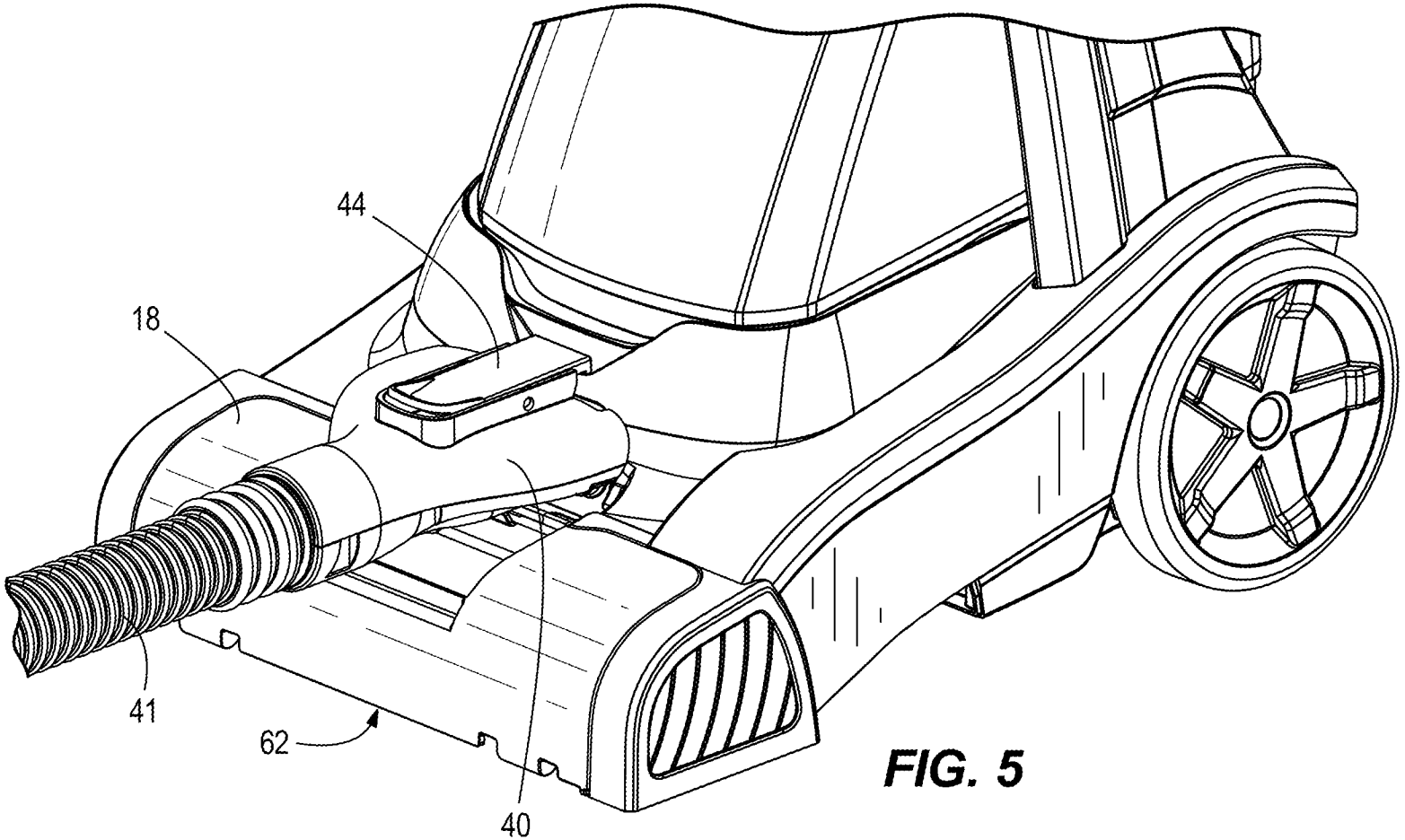
FIG. 5 is the perspective view of FIG. 2 shown with the nozzle removed and with an accessory in a coupled position.

Referring to FIG. 4, the base 14 includes an agitator 16 operatively positioned in an agitator chamber 15 to engage the surface to be cleaned 100. The agitator chamber 15 has a top opening 60 and a bottom opening 62. The agitator 16 is configured to engage the cleaning surface through the bottom opening 62 during operation. The agitator 16 is covered by an agitator cover 18. In the illustrated embodiment, the agitator cover 18 is over the top opening 60 when coupled. In the embodiment shown in FIG. 4, the agitator cover 18 is pivotable away from the base 14 to allow cleaning or maintenance of the agitator 16 through the top opening 60.

The supply tank 22 and a fluid distributor 26 are coupled to the housing 11. The fluid distributor 26 is in fluid communication with the supply tank 22 and is configured to deliver fluid to the cleaning surface 100 in the upright mode and when the surface cleaner 10 is in a reclined use position. In the embodiment illustrated in FIGS. 1-6, the fluid distributor 26 is in the base 14. The fluid dispensed through the fluid distributor 26 is agitated by the agitator 16 to clean the surface 100. The resulting soiled fluid is then vacuumed up by the surface cleaner 10 and stored in the recovery tank 30.

Figure 6:
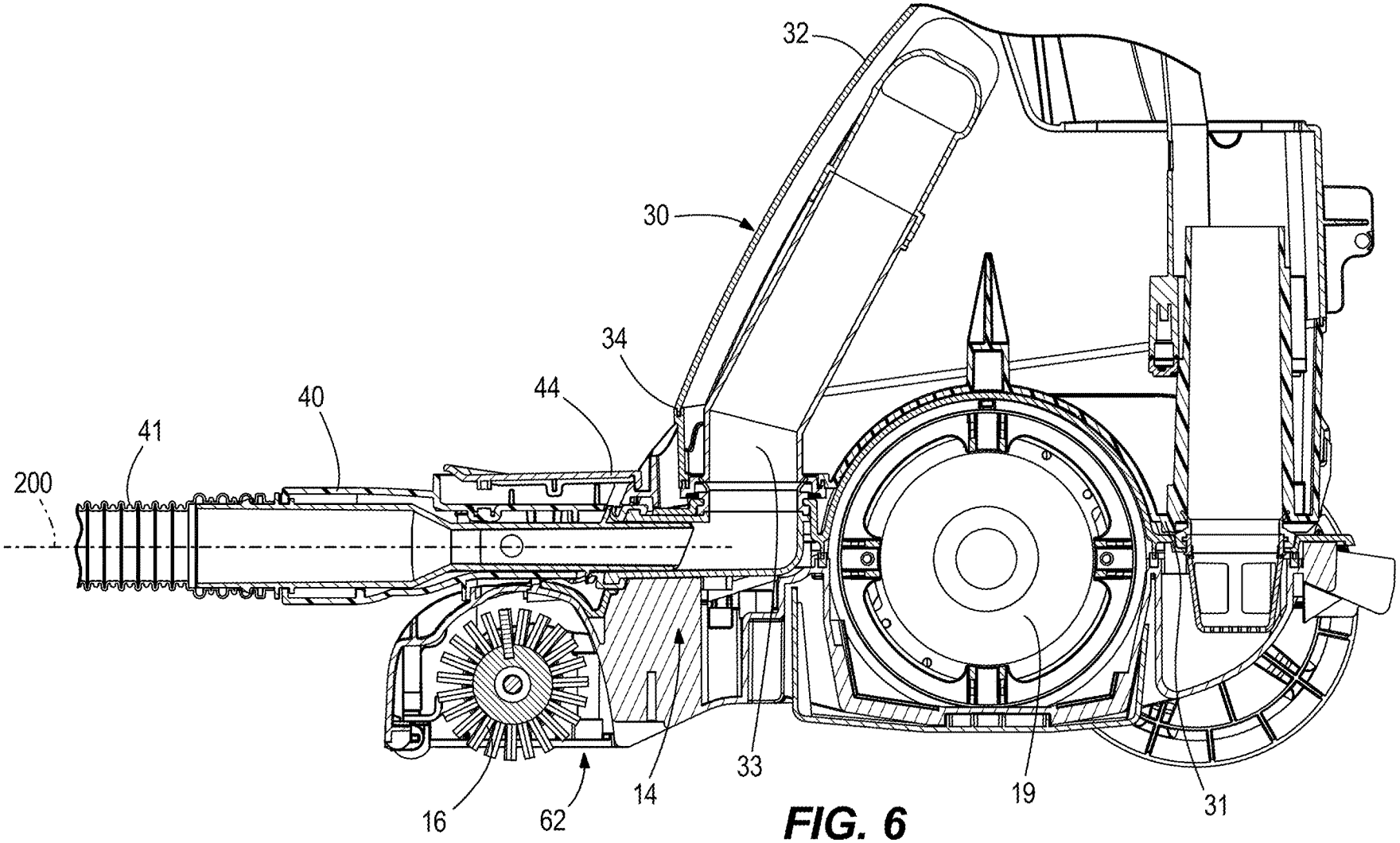
FIG. 6 is a cross-sectional view of FIG. 5.

Referring to FIG. 6, the recovery tank 30 is coupled to the housing 11 and is in fluid communication with suction source 19 to vacuum up the soiled fluid from the cleaning surface 100. The recovery tank 30 has an upper portion 32, a lower portion 34, and a recovery tank inlet 33 disposed in the lower portion 34. The lower portion 34 is adjacent the base 14 and adjacent the cleaning surface 100 while the upper portion 32 is opposite the lower portion 34. In the embodiment illustrated in FIG. 6, the recovery tank inlet 33 is disposed in a bottom wall 31 of the recovery tank 30. The bottom wall 31 is adjacent the base 14 and in the illustrated embodiment, the bottom wall 31 contacts or sets on the base 14. The base 14 includes a suction inlet port 35 (FIG. 4) in fluid communication with the recovery tank inlet 33.

A nozzle 20 (FIG. 2) is removably coupled to the suction inlet port 35 to connect a nozzle inlet 21 to the recovery tank 30. The nozzle 20 extends over the agitator cover 18. When the surface cleaner 10 is used in the upright mode with the nozzle 20 coupled, soiled fluid is vacuumed along a passageway from the nozzle inlet 21, through the suction inlet port 35 which is engaged by the nozzle 20, through the recovery tank inlet 33 and into the recovery tank 30. When the nozzle 20 is removed from the base 14 (FIG. 3), the suction inlet port 35 is exposed such that an accessory 40 may be coupled to the suction inlet port 35 for a spot or above floor mode.

In the embodiment illustrated, the base 14 further includes a fluid supply port 24 in fluid communication with the supply tank 22. When the nozzle 20 is removed and the accessory 40 is attached and coupled to the fluid supply port 24, the fluid supply port 24 delivers fluid from the supply tank 22 to the accessory 40.

Figure 10:
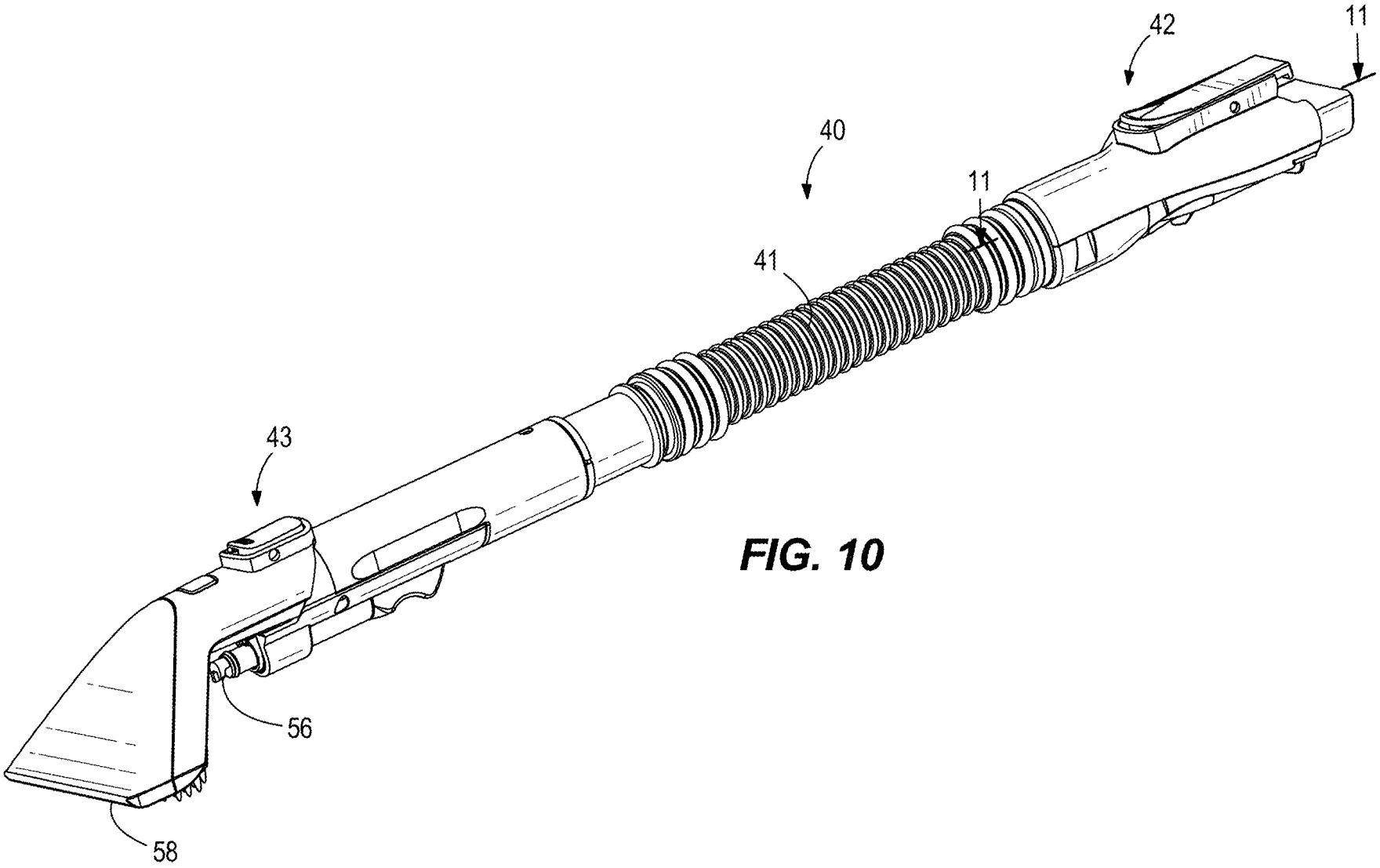
FIG. 10 is a perspective view of an accessory including a tool, according to one embodiment.
Figure 11:
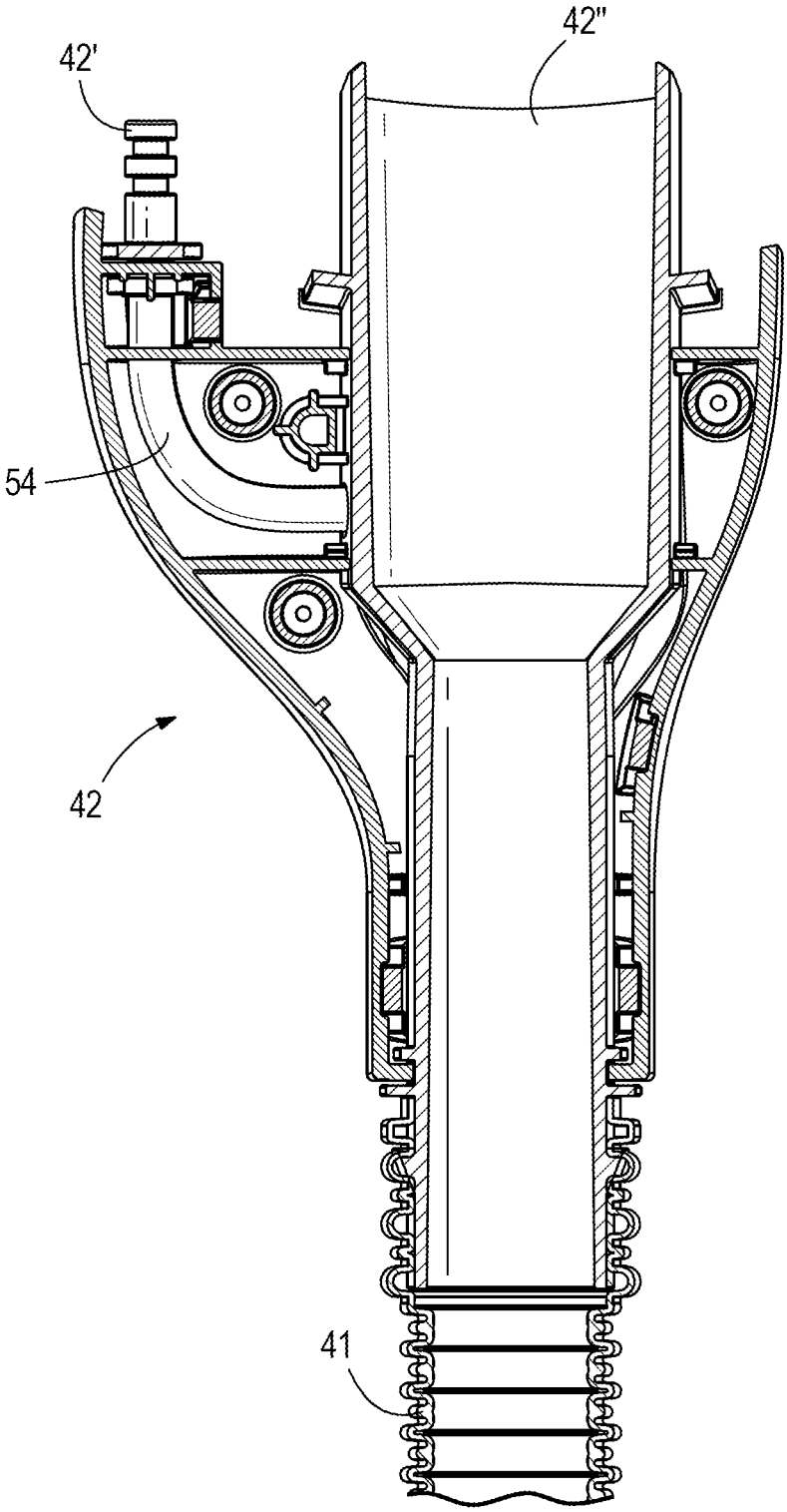
FIG. 11 is a cross-sectional view of a hose connector of the accessory shown in FIG. 10.

The accessory 40 includes a hose 41 and a tool 43 (FIG. 10) at the distal end of the hose 41. The accessory 40 further includes a hose connector 42 at the proximal end or the opposite end of the hose 41 from the tool 43. The hose connector 42 is configured to couple the accessory 40 to the surface cleaner 10. The hose connector 42 includes a fluid connector 42' (FIG. 11) to operatively connect to the fluid supply port 24. The hose connector 42 further includes a suction connector 42" to operatively connect to the suction inlet port 35. The fluid connector 42' may be separate from the hose connector 42 or may be integrated into the hose connector 42. In the embodiment illustrated in FIGS. 10 and 11, the tool 43 includes a fluid tube 54 and tool fluid distributor 56 in fluid communication with the fluid connector 42', the fluid supply port 24, and the supply tank 22. Fluid flows from the supply tank 22, through the fluid supply port 24 and the fluid connector 42', through the fluid tube 54 that extends along the hose 41 to the tool distributor 56 to dispense fluid to the surface to be cleaned. The tool 43 further includes a suction inlet 58 to vacuum up the debris and soiled fluid. The vacuumed debris and fluid is moved through the suction inlet 58, to the hose 41 along a suction pathway and into the recovery tank 30. The tool 43 may further act to agitate the surface to be cleaned. The tool maybe an agitating tool, a brush tool, a squeegee tool, or the like.

In the embodiment shown, the suction inlet port 35 defines an inlet axis 200 and the connection of the accessory 40 to the suction inlet port 35 and the fluid supply port 24 is along the inlet axis 200. In one embodiment, the inlet axis 200 is substantially parallel to the surface to be clean 100 and the inlet axis 200 extends centrally through the suction inlet port 35 substantially parallel to the surface 100. This arrangement provides several advantages compared to a connection at a different angle, such as substantially perpendicular to the surface to be cleaned. The parallel connection creates a more straight and direct airpath to the recovery tank 30 and inhibits kinking of the hose of the accessory 40 when the hose 41 is pulled. The substantially parallel connection also allows the user to pull the accessory 40 to move surface cleaner 10 when additional length is needed. The pull force is much less likely to tip over the surface cleaner when pulled from the front because the force is in the direction of movement. Additionally, because the connection is substantially parallel to the surface 100, dripping from the accessory 40 when removed is reduced.

In the embodiment illustrated, the fluid connector 42' (FIG. 10) and the suction connector 42" are arranged side by side. In the embodiment illustrated in FIG. 7, the hose connector 42 further includes a protrusion 46 extending along the suction connector 42". The protrusion 46 is positioned to engage a slot 36 (FIG. 8) positioned in or adjacent the suction inlet port 35. The protrusion 46 and the slot 36 interact axially along inlet axis 200 to retain the accessory 40 when coupled. The protrusion 46 provides support to the hose connector 42. Further, in embodiments where the suction inlet port 35 is round, the protrusion 46 acts to align the hose connector 42. In the illustrated embodiment, the slot 36 is positioned inside the suction inlet port 35, however in another embodiment the slot is positioned outside and adjacent the suction inlet port 35. The protrusion 46 and the slot 36 may be a t-slot, tongue and groove connection, guide rail connection or the like. In the embodiment shown in FIG. 8, the slot 36 is a guide rail that helps guide and support the protrusion 46 when the accessory 40 is being coupled. In the embodiments illustrated, the accessory 40 further includes a latch 44. The latch 44 is configured to engage a portion of the housing 11, specifically the base 14 to selectively couple the accessory 40 to the surface cleaner 10.

In the embodiments illustrated, when the nozzle 20 is removed from the base 14, the suction inlet port 35 and the fluid supply port 24 are accessible allowing the user to connect the accessory 40. In other embodiments, the fluid supply port 24 is not covered by the nozzle 20 when the nozzle 20 is coupled to the base 14, but rather is covered separately by an openable door.

When the nozzle 20 is removed, the agitator cover 18 is exposed, but remains coupled over the agitator 16. The agitator cover 18 reduces user contact with the agitator 16, especially when attaching and using the accessory 40. The agitator cover 18 is openable (FIG. 4) to access the agitator 16 for cleaning and maintenance through the top opening 60 when the nozzle 20 is removed. In the embodiment illustrated in FIG. 4, the agitator cover 18 pivots to allow access to the agitator 16. In one embodiment, the agitator cover 18 remains attached to the base 14 when opened. In one embodiment, the agitator cover 18 is detached from the base 14 when opened.

Figure 9:
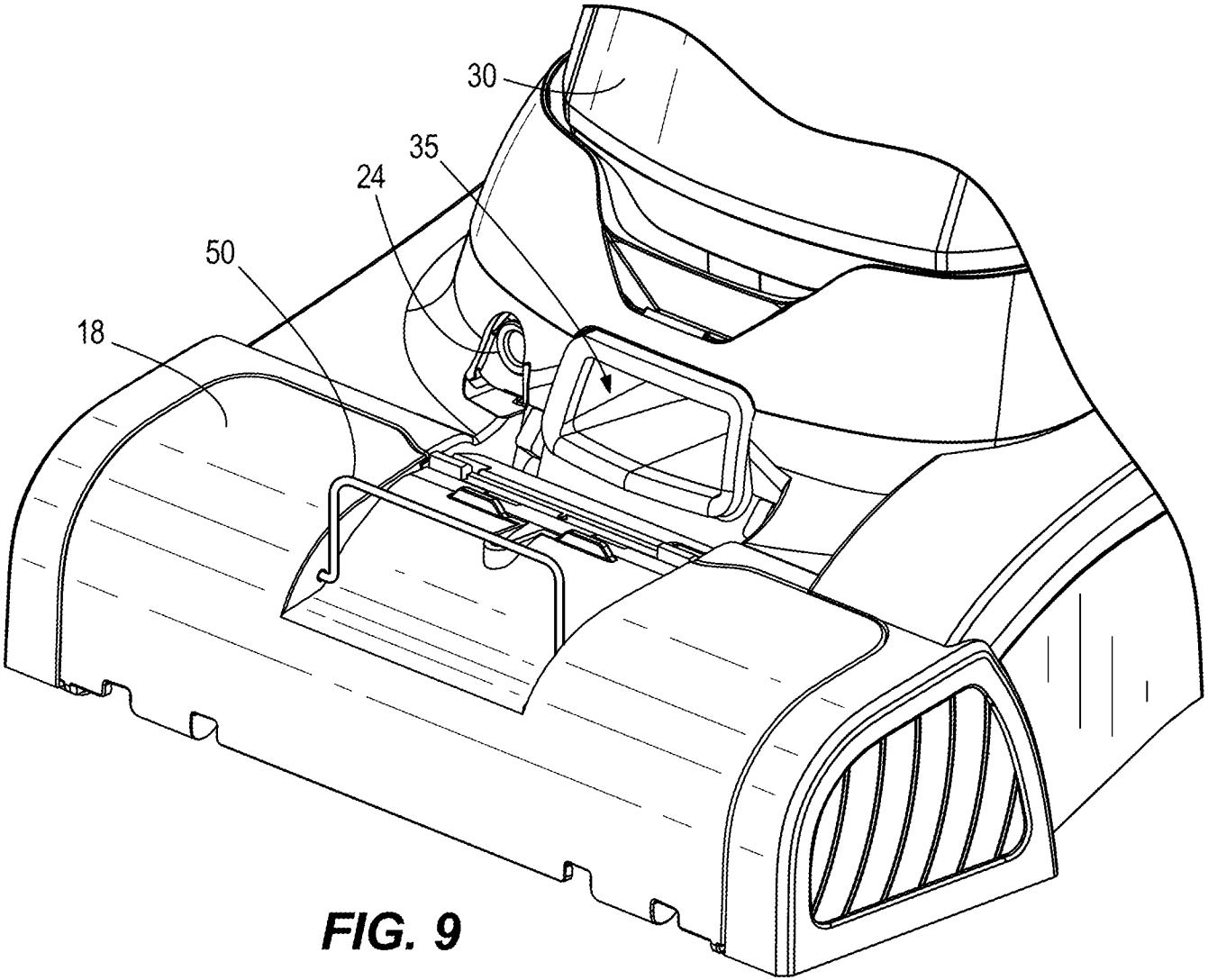
FIG. 9 is a perspective view of a base of a surface cleaner with a nozzle removed and an accessor in a removed position, according to an alternative embodiment.
Figure 12:
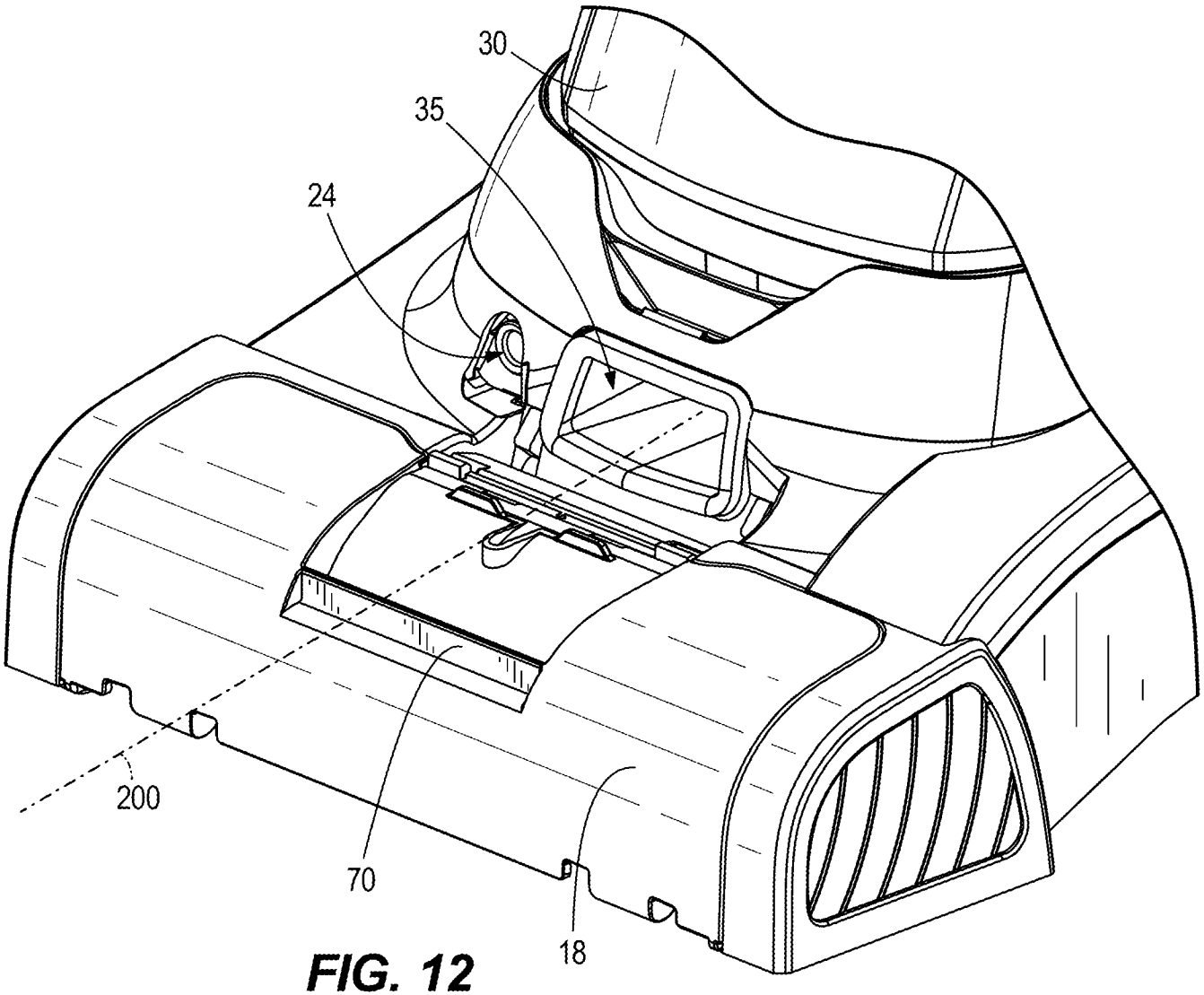
FIG. 12 is a perspective view of a base of a surface cleaner with a nozzle removed and an accessory removed, according to an alternative embodiment.

In the embodiment shown in FIG. 9, the agitator cover 18 includes a handle 50. The handle 50 is positioned to lay flat when the agitator cover 18 is attached and be rotatable upwards (FIG. 9) to allow the user to grasp the handle 50 to pivot the agitator cover 18 away from the agitator 16. In the embodiment shown in FIG. 4, the agitator cover 18 includes two tabs 52 positioned for the user to grasp the tabs and pivot the agitator cover 18 away from the agitator 16. The tabs 52 provide a raised portion of the agitator cover 18 for the user to interact with to remove the agitator cover 18. In the embodiment illustrated in FIG. 12, the agitator cover 18 includes a rib 70 positioned for the user to grasp the rib 70 and pivot the agitator cover 18 away from the agitator 16. The rib 70 is substantially perpendicular to the inlet axis 200. One benefit of the agitator cover 18 being pivotal and connected to the base 14 rather than fully removable is that it keeps the agitator cover 18 from being lost. Another benefit of the agitator cover 18 being pivotal, combined with the accessory 40 connection location, is that the user has to return the agitator cover 18 to the closed position in order to connect the accessory 40.

Figure 7:
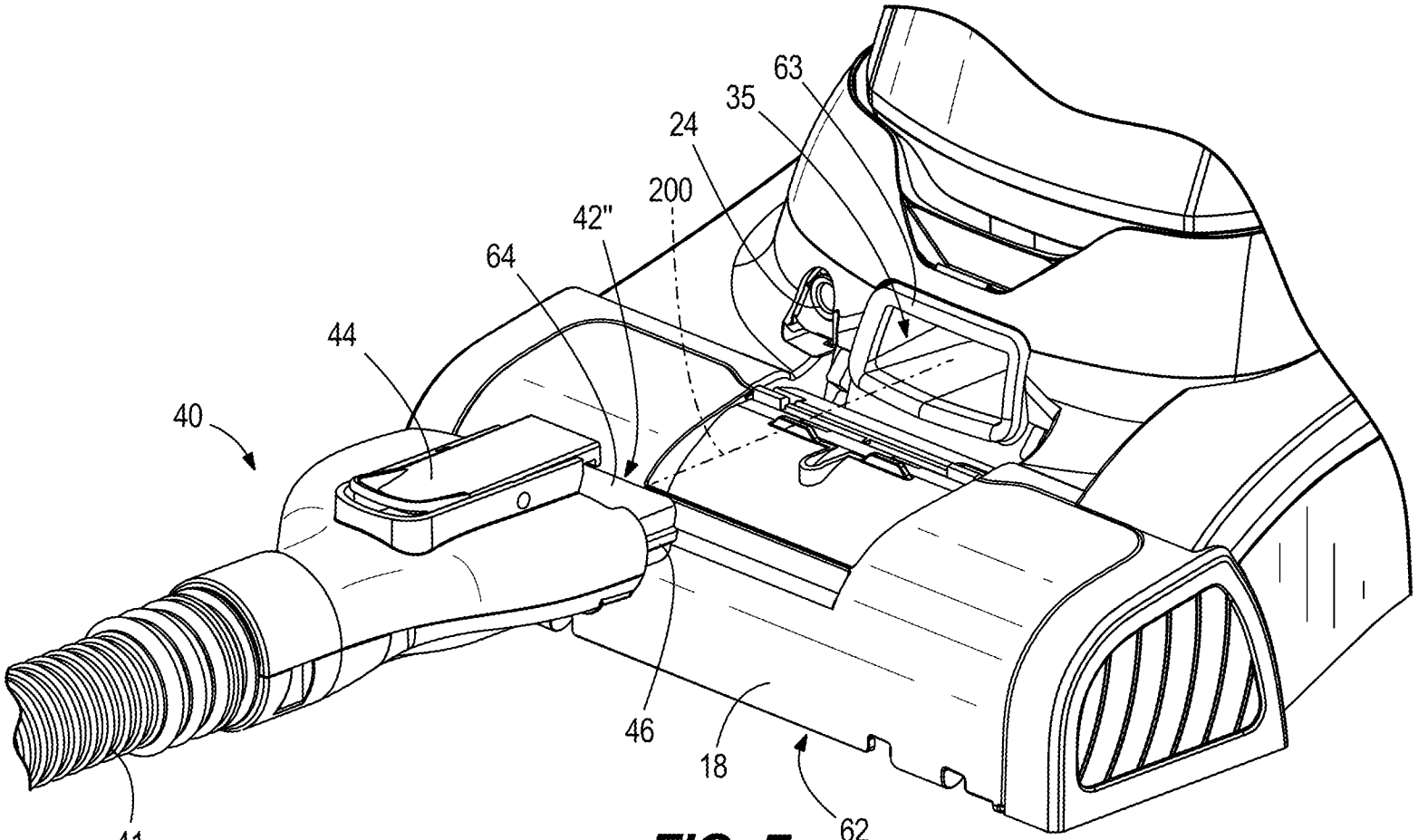
FIG. 7 is a perspective view of a base of a surface cleaner with a nozzle removed and an accessory in a removed position, according to an alternative embodiment.
Figure 8:
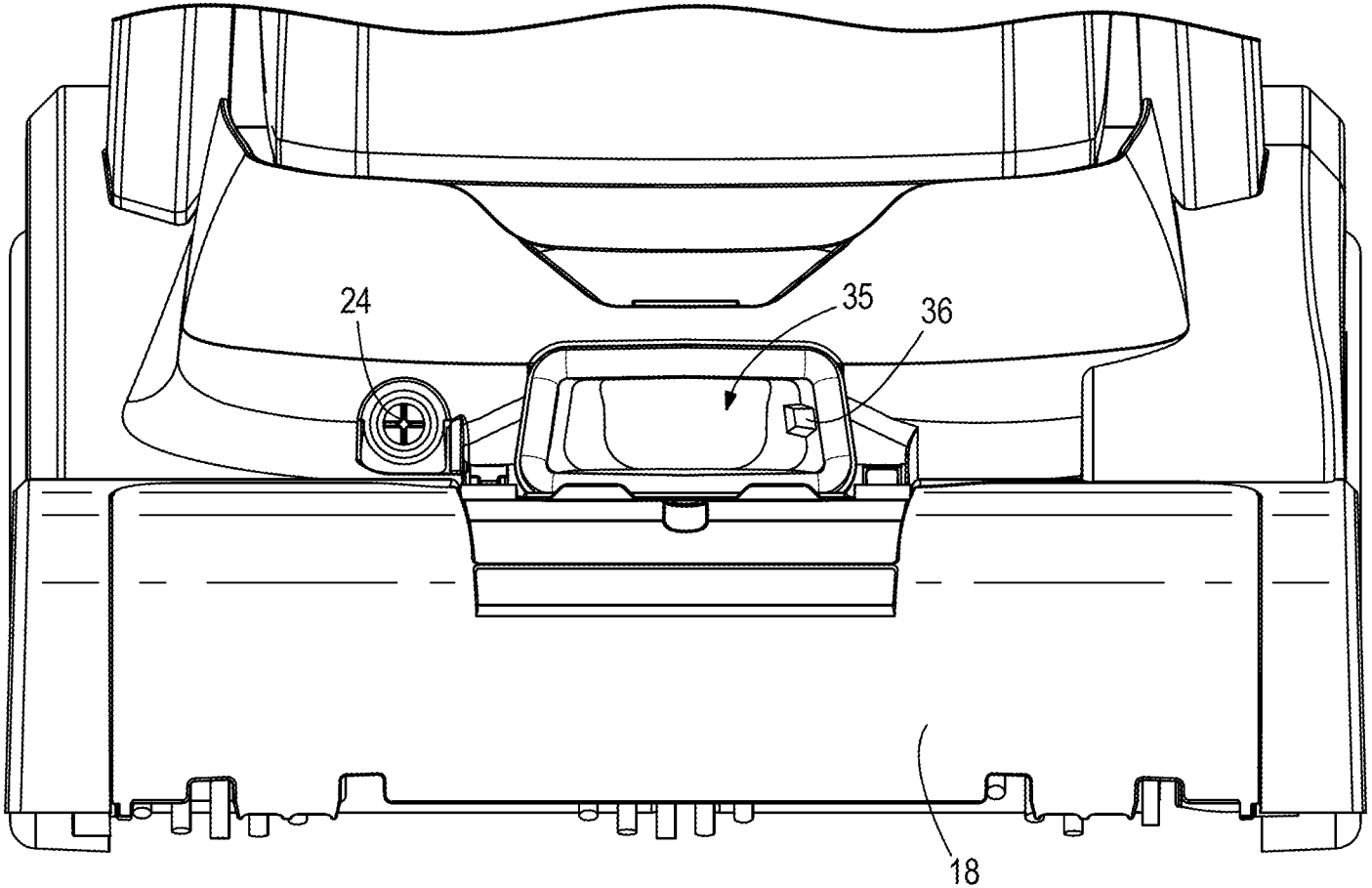
FIG. 8 is a front side view of the embodiment of FIG. 7 with the nozzle removed and the accessory removed.

In the embodiment illustrated in FIG. 7, the suction inlet port 35 includes a seal 63 to engage the nozzle 20 in the coupled position to inhibit air ingress and liquid egress around the connection. The seal 63 is also positioned to engage the accessory 40, specifically the suction connector 42" when the accessory 40 is coupled to inhibit air ingress and liquid egress around the connection. In one embodiment illustrated in FIG. 7, the suction connector 42" includes a tubular portion 64 positioned to enter the suction inlet port 35 in the connected position. The tubular portion 64 of the suction connector 42" acts to direct the accessory 40 into the suction inlet port 35. In one embodiment, not shown, the nozzle includes a sealing member to engage the suction inlet port 35 to prevent liquid egress in the upright mode, where the surface cleaner is in the reclined use position. In one embodiment the seal on the nozzle is in place of the seal 62 on the suction inlet port 35. In an alternate embodiment the seal on the nozzle is in addition to the seal 62 on the suction inlet port 35.

In the upright mode or reclined use position, the supply tank 22 is in fluid communication with a hose to deliver liquid to the fluid distributor 26 in the base 14 of the surface cleaner 10. In the illustrated embodiment, the fluid distributor 26 is gravity feed and activated by an actuator, such as a user-graspable trigger. The accessory 40 is in fluid communication with the supply tank 22 via the fluid tube 54 connected to the fluid supply port 24. The fluid supply port 24 is in fluid communication with a pump 60 to deliver fluid to the fluid connector 42' of the accessory 40. In one embodiment, not shown, there is one hose with a split Y tube connecting the supply tank 22 to the fluid distributor 26 and the fluid supply port 24. In this embodiment, the surface cleaner 10 further includes a solenoid to appropriately route the fluid to the fluid distributor 26 or the fluid supply port 24 based on cleaning mode.

Various features and advantages of the invention are set forth in the following claims.

What is claimed is:

1. A surface cleaner comprising:

a housing including a body and a base, the base pivotably coupled to the body and configured to support the body above a cleaning surface;

a recovery tank coupled to the housing having an upper portion, a lower portion, and a recovery tank inlet disposed in the lower portion, the recovery tank lower portion includes a tank bottom wall and the recovery tank inlet is in the tank bottom wall;

the base having a suction inlet port in fluid communication with the recovery tank inlet, the suction inlet port defining an inlet axis that extends centrally through the suction inlet port, the suction inlet port extends through the base under the tank bottom wall of the recovery tank;

a nozzle removably coupled to the suction inlet port connecting a nozzle inlet to the recovery tank;

wherein the suction inlet port is accessible when the nozzle is uncoupled from the base;

an accessory having a hose connector connectable to the suction inlet port when the nozzle is uncoupled from the base, the accessory extending along the inlet axis when coupled.

2. The surface cleaner of claim 1, wherein the recovery tank is disposed above the inlet axis.

3. The surface cleaner of claim 1, further comprising an agitator operably positioned in an agitator chamber having a top opening and a bottom opening, the agitator configured to engage the cleaning surface through the bottom opening during operation, and the agitator accessible through the top opening for cleaning when the nozzle is uncoupled.

4. The surface cleaner of claim 3, wherein the agitator is removable from the agitator chamber through the bottom opening.

5. The surface cleaner of claim 3, further comprising an agitator cover positioned between the nozzle and the agitator, wherein the agitator cover is openable when the nozzle is uncoupled.

6. The surface cleaner of claim 5, where the agitator cover is pivotably openable.

7. The surface cleaner of claim 5, wherein the agitator cover includes a user-graspable bail handle to move the agitator cover.

8. The surface cleaner of claim 5, wherein the agitator cover is positioned over the top opening of the agitator chamber.

9. The surface cleaner of claim 1, further comprising a supply tank and a fluid distributor coupled to the housing, the fluid distributor in fluid communication with the supply tank configured to deliver fluid to the cleaning surface.

10. The surface cleaner of claim 9, further comprising a fluid supply port in fluid communication with the supply tank, the accessory including a fluid coupling, wherein the fluid coupling is connectable to the fluid supply port when the hose connector is connected to the suction inlet port.

11. The surface cleaner of claim 10, wherein the fluid supply port is positioned on the base adjacent the suction inlet port and below the recovery tank.

12. The surface cleaner of claim 10, wherein the fluid supply port and the suction inlet port are arranged side by side.

13. The surface cleaner of claim 10, wherein the fluid supply port is exposed when the nozzle is uncoupled.

14. The surface cleaner of claim 1, wherein the accessory includes a latch engageable with the base to retain the accessory when connected.

15. The surface cleaner of claim 1, wherein the accessory is in an orientation substantially parallel to the cleaning surface when the hose connector is connected.

16. The surface cleaner of claim 1, wherein the accessory further comprises a protrusion positioned to engage a slot adjacent the suction inlet port, the protrusion and slot extending along the inlet axis when the accessory is coupled.

17. The surface cleaner of claim 16, wherein the slot on the suction inlet port is positioned along an inside wall of the suction inlet port.

18. The surface cleaner of claim 16, wherein the protrusion is a guide rail.

19. The surface cleaner of claim 1, wherein the accessory includes a seal around the hose connector to engage around the suction inlet port when coupled.

20. The surface cleaner of claim 1, further comprising an agitator operably positioned in an agitator chamber having a bottom opening, the agitator configured to engage the cleaning surface through the bottom opening during operation, wherein the inlet axis extends above the agitator chamber and below the bottom wall of the recovery tank such that the suction inlet port is above the agitator and below the bottom wall of the recovery tank.

* * * * *